US005778725A

United States Patent [19]

Kirschner et al.

[11] Patent Number: 5,778,725

[45] Date of Patent: Jul. 14, 1998

[54] ASSEMBLY AND METHOD FOR TESTING AN UNDERWATER GUN

[75] Inventors: Ivan N. Kirschner, Portsmouth; Gary R. Berlam, Warwick, both of R.I.

[73] Assignee: The United States of America as represented by the Secretary of the Navy, Washington, D.C.

[21] Appl. No.: 759,821

[22] Filed: Nov. 7, 1996

[51] Int. Cl.[6] ..... G01L 5/14

[52] U.S. Cl. ..... 73/167

[58] Field of Search ..... 73/167; 324/178, 324/179, 207.22, 207.23

[56] References Cited

U.S. PATENT DOCUMENTS

| | | | |
|---|---|---|---|
| H279 | 6/1987 | Roecker | 73/167 |
| 3,656,956 | 4/1972 | Dalzell, Jr. | 73/167 |
| 3,792,354 | 2/1974 | Slaght et al. | 324/178 |
| 5,125,343 | 6/1992 | Domen et al. | 73/167 |
| 5,531,113 | 7/1996 | Jamison | 73/167 |

*Primary Examiner*—Robert Raevis

*Attorney, Agent, or Firm*—Michael J. McGowan; Prithvi C. Lall; Michael F. Oglo

[57] ABSTRACT

A test assembly for testing an underwater gun in a tank of liquid includes for disposition in the tank in the liquid, a mount for accepting and retaining the gun to be tested, a plurality of baffle plates, each having an aperture therethrough for alignment with a muzzle portion of the gun, a plurality of witness screens for alignment with the gun muzzle portion, a plurality of motion detection sensors for alignment with the apertures of the baffle plates, and a bullet receptacle for alignment with the gun muzzle portion for receiving a bullet fired from the gun. The invention further contemplates a method for testing underwater guns, utilizing the above assembly.

14 Claims, 4 Drawing Sheets

ASSEMBLY AND METHOD FOR TESTING AN UNDERWATER GUN

STATEMENT OF GOVERNMENT INTEREST

The invention described herein may be manufactured and used by or for the Government of the United States of America for governmental purposes without payment of any royalties thereon or therefor.

BACKGROUND OF THE INVENTION (1) Field of the Invention

The invention relates to testing of firearms and is directed more particularly to testing of underwater guns.

(2) Description of the Prior Art

Until recently, it has not been feasible to shoot bullets underwater. Currently, however, supercavitation drag reduction allows bullets to be fired underwater at velocities sufficiently high to inflict damage on a target.

It is now deemed desirable to have a test range and method for testing such underwater guns and bullets, wherein velocities and trajectories can be measured, and fired bullets recovered intact for further study. It is further deemed desirable to have available a test assembly which can be erected in available tanks, or other bodies of water, and disassembled and stored when not in use.

SUMMARY OF THE INVENTION

It is, therefore, an object of the invention to provide a test assembly for testing an underwater gun in a tank or other body of liquid.

A further object of the invention is to provide such a test assembly as can be placed piecemeal in any available tank and, after use, disassembled and stored in a relatively small space.

A still further object of the invention is to provide a method for testing an underwater gun in a tank of liquid.

With the above and other objects in view, as will hereinafter appear, a feature of the present invention is the provision of a test assembly for testing an underwater gun in a body of liquid, the assembly comprising, each for disposition in body of liquid, the following components: (1) a mount for accepting and retaining the gun to be tested, with the barrel portion of the gun extending along an axis ("nominal trajectory"); (2) a plurality of aligned baffle plates, each having an aperture therethrough for orientation perpendicularly to the nominal trajectory and for alignment with the nominal trajectory; (3) a plurality of witness screens for alignment with the nominal trajectory; (4) a plurality of motion detection sensors for mounting in alignment with the apertures of the baffle plates; and (5) a bullet receptacle for alignment with the nominal trajectory for receiving a bullet fired from the gun.

In accordance with a further feature of the invention, there is provided a method for testing an underwater gun in a body of liquid, the method comprising providing a test assembly comprising the following components: (1) a mount for accepting and retaining the gun to be tested, (2) a plurality of baffle plates each having an aperture therethrough, (3) a plurality of witness screens, (4) a plurality of motion detection sensors, and (5) a bullet receptacle. The components are placed in the body of liquid in alignment with each other such that a bullet fired from the gun in the mount can pass through the apertures in the baffle plates, through the witness screens, through the sensors, and into the receptacle. The sensors provide a measure of bullet position as a discrete function of time; the witness screens provide an indication as to the trajectory of the bullet; and the receptacle retains for retrieval and examination any bullet that traverses the entire range.

The above and other features of the invention, including various novel details of construction and combinations of parts, will now be more particularly described with reference to the accompanying drawings and pointed out in the claims. It will be understood that the particular device and method embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENTS

Figure 1:
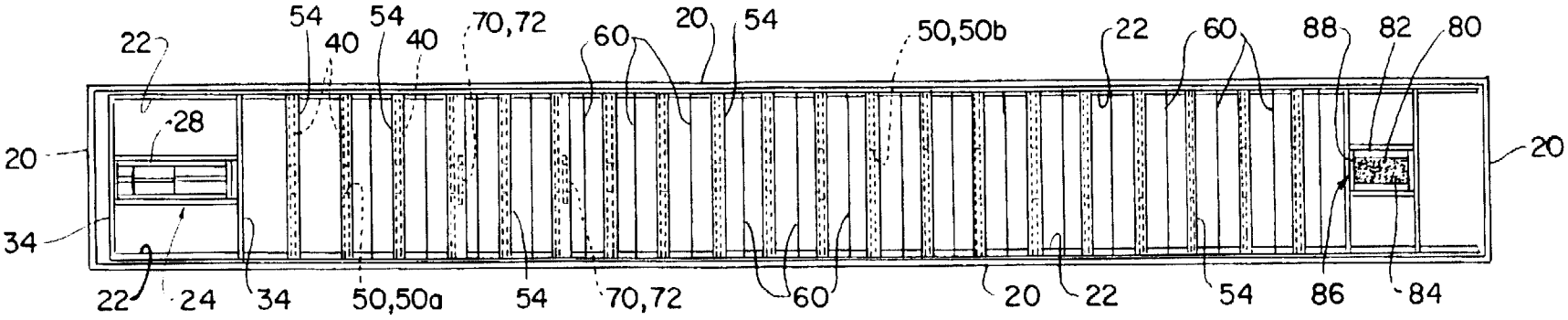
FIG. 1 is a top plan view of one form of testing assembly illustrative of an embodiment of the invention.

Referring to FIG. 1, it will be seen that the illustrative assembly is for disposition within a tank 20, which may be an existing tank for retaining water, such as, for example, a tank for model testing of water vehicles. Such tanks customarily are provided with carriage rails 22 on which there may be mounted means for retaining and moving a model in the tank through the water in the tank. Alternatively, the assembly may be disposed in any suitable body of water, natural or man-made.

Figure 2:
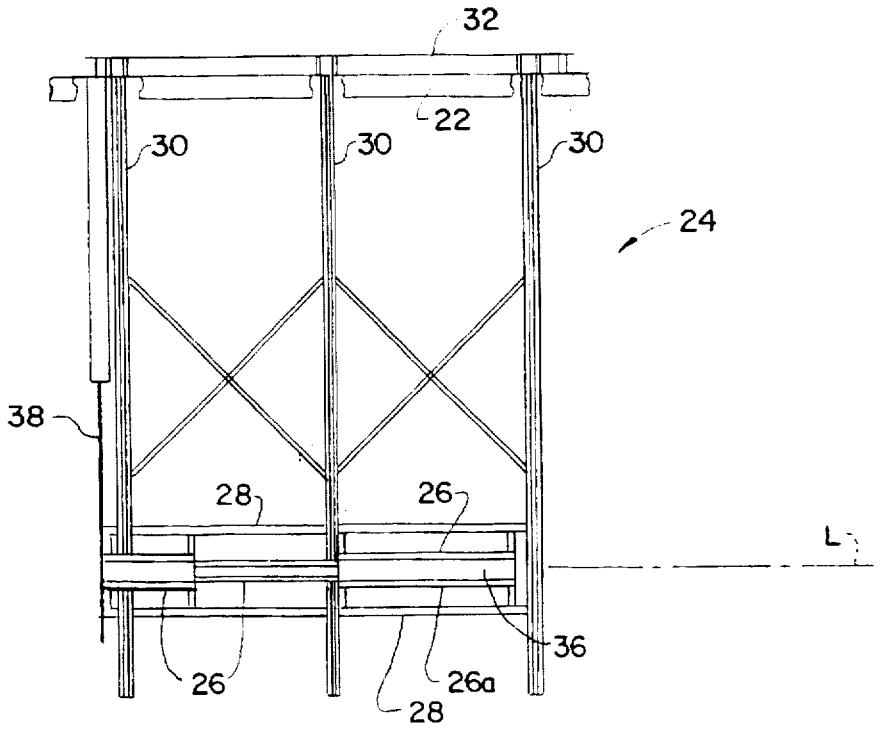
FIG. 2 is a side elevational view of a typical gun mount portion of the assembly.

The underwater gun test assembly of the present invention includes a gun mount 24 (FIG. 2) which comprises gun barrel retaining cylinders 26 fixed in brackets 28. The brackets 28 are fixed to vertical support beams 30, which depend from longitudinal support beams 32 fixed to cross beams 34 (FIG. 1), supported by the carriage rails 22. Other appropriate support means may be used if a body of liquid other than a model test tank is used. In use, a muzzle portion of a gun barrel (not shown) is disposed in the inward-most barrel retaining cylinder 26*a*. Upon firing, a bullet exits barrel retaining cylinder 26*a* at an inboard end 36 thereof. A recoil plate 38 (FIG. 2) can be fixed to mount 24 and provides a hydrodynamically-loaded surface against which the inner rolling cylinder 26 may recoil and be yieldingly decelerated.

It will be apparent that any mounting system capable of retaining the underwater gun and its barrel can be used in the gun mount. For example, the gun may be mounted on an inner rolling rack that moves with respect to an outer fixed rack joined to the mount.

Figure 3:
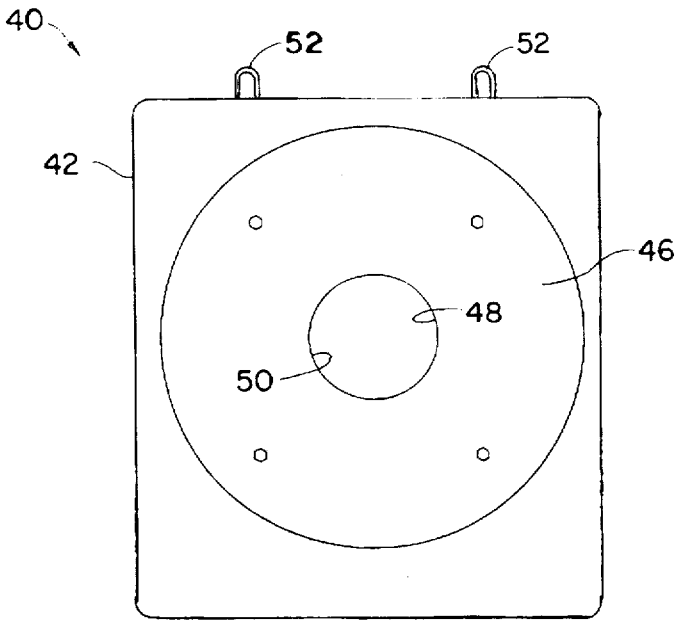
FIG. 3 is a front elevational view of a typical baffle plate portion of the assembly.
Figure 4:
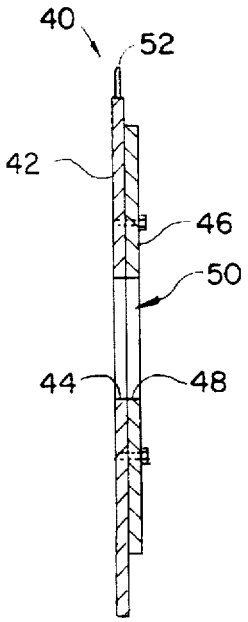
FIG. 4 is a center line sectional view of the baffle plate of FIG. 3.

The assembly includes a plurality of baffle plates 40 (FIGS. 3 and 4), each comprising a planar base plate 42 having an aperture 44 therethrough. Fixed to base plate 42 is a second plate 46 having an aperture 48 therethrough. The apertures 44 and 48 are in alignment with each other to form a baffle plate aperture 50 extending through the baffle plate 40. Baffle plate 40, preferably the base plate portion 42 thereof, is provided with shackles 52, or the like, by which baffle plates 40 can be hung from cross-bars 54 (FIG. 1) which extend, in the illustrative embodiment, widthwise of tank 20, from one carriage rail 22 to the other. Baffle plates 40, in usage, are suspended in tank 20 at regular intervals with baffle apertures 50 in alignment with the nominal trajectory, a hypothetical straight line L (FIG. 2) extending from the axis of gun barrel retaining cylinder 26, such that the straight line L passes through the baffle apertures 50. Baffle plates 40 near gun mount 24 are provided with appropriately small apertures 50*a* (FIG. 1), while baffle plates 40 spaced well from gun mount 24 can be provided with larger apertures 50*b*, to accommodate the variation in bullet trajectory as the bullet progresses down range. The second plate portions 46 of baffle plates 40 are of a durable, dense material adapted to withstand bullet impacts. Thus, baffle plates 40 serve to prevent bullet travel in unexpected directions removed from the nominal trajectory of the bullet.

Figure 5:
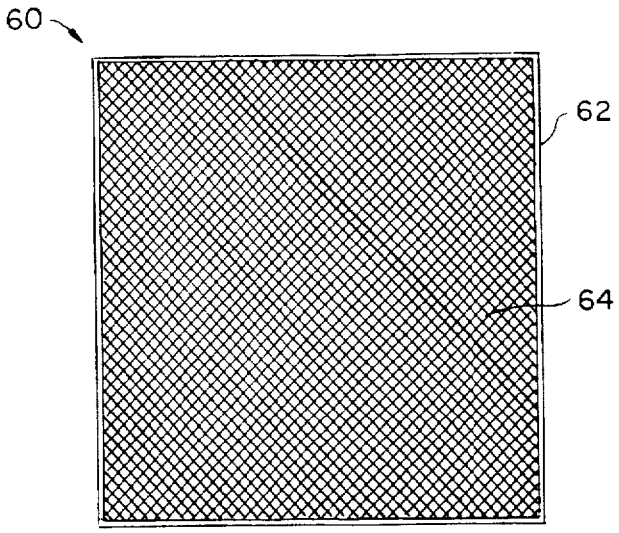
FIG. 5 is a front elevational view of a typical witness screen portion of the assembly.
Figure 6:
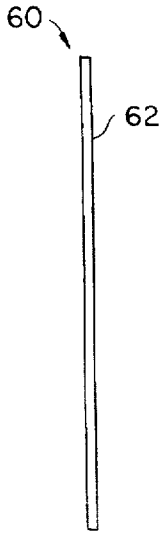
FIG. 6 is a side elevational view of the witness screen of FIG. 5.

The assembly further includes witness screens 60 (FIGS. 5 and 6) for alignment with the gun mount 24 and baffle plates 40. Witness screens 60 include a rigid frame 62 supporting a mesh or sheet 64 of nylon, mylar, or the like, and are adapted, as by shackles 52 of the type shown in FIG. 3 (not shown in FIGS. 5 and 6) to be suspended in tank 20 at regular intervals. The mesh 64 is easily penetrable and a bullet readily pierces mesh portions 64 of screens 60 in its travel down range. Preferably, a witness screen 60 is mounted between each pair of baffle plates 40. The witness screens 60 provide ready means for determining the trajectory of a fired bullet.

Figure 9:
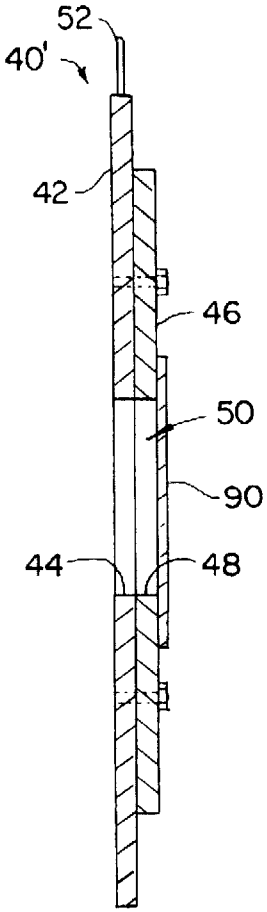
FIG. 9 is a center line sectional view of the baffle plate and witness screen of FIG. 8.
Figure 8:
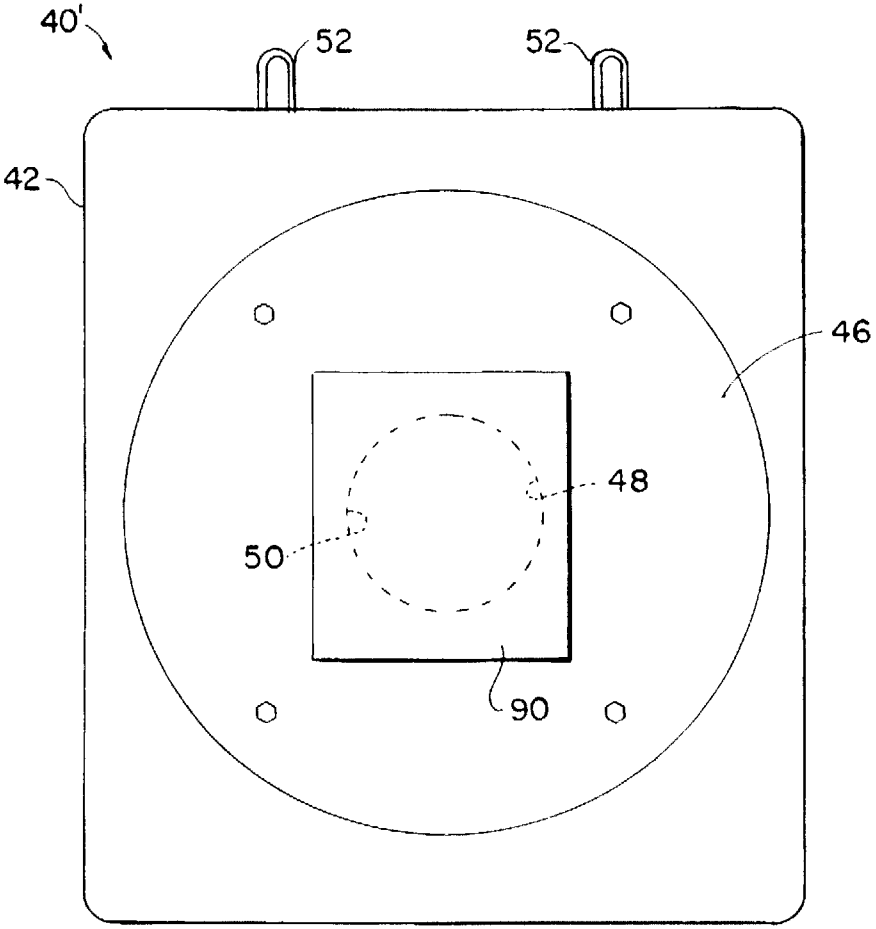
FIG. 8 is similar to FIG. 3, but illustrative of an alternative embodiment of baffle plate and witness screen.

In an alternative embodiment of baffle plate and witness screen, shown in FIGS. 8 and 9, a witness screen 90, made from a nylon or mylar sheet, is mounted on each baffle plate 40' over each baffle plate aperture 50. The screen 90 can be mounted by adhesive or fasteners to each baffle plate 40'. This embodiment reduces the number of parts required to set up the range.

Figure 7:
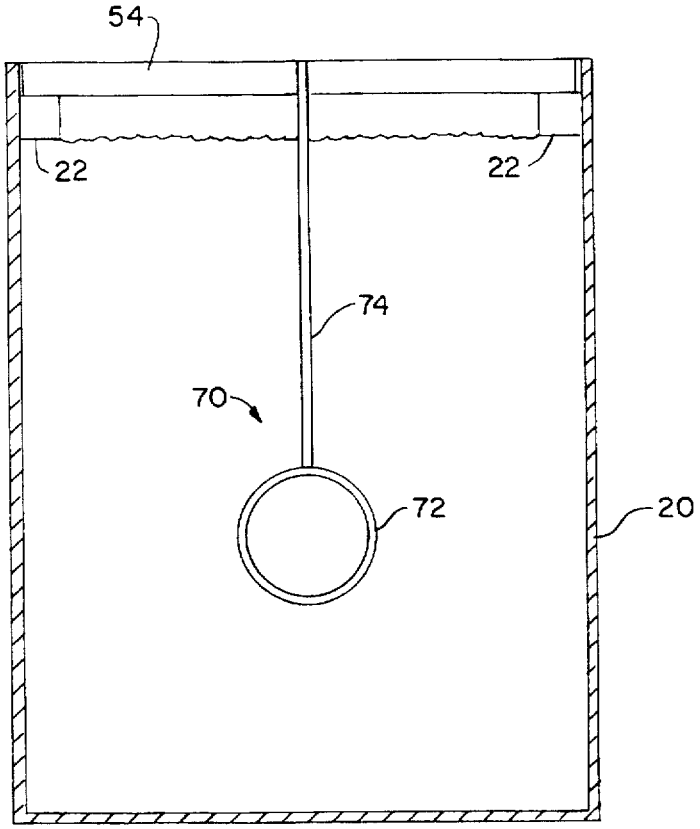
FIG. 7 is a front elevational view of a typical motion detection sensor portion of the assembly.

The assembly further includes a plurality of motion detection sensors 70, an illustrative embodiment of which is shown in FIG. 7. In this illustrative embodiment, the sensor 70 is comprised of a coil 72 of copper windings, or like conductor, for alignment with the baffle plate apertures 50 and the aforementioned nominal trajectory, L, such that a tested bullet passes through coil 72 in its passage through the assembly. Coil 72 may be fixed to a rigid strut 74 which depends from one of the cross-bars 54. When a magnet contained within a test bullet passes through coil 72, such passage generates an electromotive force in the coil which is passed through wiring (not shown) to a timer recording device (not shown). The timer recording device, in addition to recording the time of passage of the bullet, and having programmed therein the distance between sensors 70, determines a mean velocity of the bullet between each two sensors and (by similar programming) determines a mean deceleration of the bullet in the same location. The motion detection sensors 70 each may be hung adjacent to a baffle plate 40, with a baffle plate and sensor depending from the same cross-bar 54, as shown in FIG. 1.

The motion detection sensors may be any of several known embodiments of motion detection components, including inductive coils, Hall effect sensors, and printed circuit membranes. The exact spacing between sensors is not critical, provided the sensors are not so closely spaced that the passage signals become indistinguishable. The output is a record of position versus time at several discrete stations along the range, from which time history of mean velocity and deceleration can be computed.

The assembly still further includes a bullet receptacle 80 for disposition in tank 20 at an end of tank 20 furthest removed from gun mount 24. Bullet receptacle 80 comprises a housing 82 filled with a bullet capturing medium 84, such as sand and/or a foam material. Housing 82 is open at an end 86 facing gun mount 24. The open end 86 of housing 82 is at least as large as the largest of the baffle apertures 50*b*, such that a bullet having passed through the baffle plates 40, witness screens 60 and sensors 70 will enter the housing 82 and be captured by medium 84 therein. The medium 84 and housing open end 86 may be covered by an elastomeric membrane 88 which readily permits penetration by the bullet, but substantially seals itself to prevent spilling out of medium 84 from housing 82. The top of housing 82 may be open, as shown in FIG. 1, to permit easy retrieval of a bullet captured therein.

When using a model test tank, of the type shown in FIG. 1 having carriage rails 22, the carriage rails provide a ready means for suspending the components of the test assembly in the tank. Typical existing tanks can accommodate a relatively large number of test assembly components, as shown in FIG. 1. The test assembly described herein, however, is intended for use in any available body of substantially motionless water, in which case any suitable means, not a part of the invention described herein, may be used to suspend, float, or otherwise retain the test assembly components. The gun mount 24 may be suspended, rather than retained in fixed position, to permit recoil of the gun mount.

In use, the components are placed in the tank with the distances between components accurately recorded and entered into any attendant data banks. A gun to be tested is placed in the gun mount 24 and fired. A bullet fired from the gun is intended to pass through a series of the above-described baffle plates 40, witness screens 60, and proximal to motion detection sensors 70, and enter the bullet receptacle 80. The sensors 70 measure the velocity of the bullet. The witness screens 60, having been penetrated by the bullet, provide a trajectory path. The bullet receptacle captures any bullet that traverses the entire range for retrieval and examination. In practice, due to the nature of scientific or developmental testing of such bullets and guns, not all bullets tested traverse the entire range.

Upon completion of the tests, the components of the assembly can be removed, disassembled, and stored, permitting return of the tank or body of water to its normal usage.

There is thus provided an underwater gun test range assembly, which assembly can be erected in an existing tank or body of water and, after use, can be disassembled and stored in minimal space. There is further provided a method for testing underwater guns and bullets for velocity and trajectory, and for retrieving a fired bullet intact.

It is to be understood that the present invention is by no means limited to the particular construction herein disclosed and/or shown in the drawings, but also comprises any modifications or equivalents within the scope of the claims.

What is claimed is:

1. A test assembly for testing an underwater gun in a body of liquid, said assembly for disposition in the body of liquid comprising:

a mount for accepting and retaining the gun to be tested, with a barrel portion of the gun extending along an axis;

a plurality of baffle plates, each having an aperture therethrough for alignment with the axis;

a plurality of witness screens for alignment with the axis;

a plurality of motion detection sensors for mounting in alignment with said apertures of said baffle plates, said motion detection sensors comprising electrical sensors in which passage of a bullet therethrough generates a signal in said sensors, which signal is detectable to enable determination of time of bullet passage past one of said sensors; and a bullet receptacle for alignment with the axis.

2. The test assembly in accordance with claim 1 wherein in at least a first said baffle plate aperture is smaller than a last said baffle plate aperture, said last baffle plate being further removed from said mount than said first baffle plate.

3. The test assembly in accordance with claim 2 wherein said baffle plates are at least in part of a material adapted to stop a bullet which strikes said material.

4. The test assembly in accordance with claim 1 wherein each of said witness screens comprises a planar mesh bound by a rigid frame.

5. The test assembly in accordance with claim 1 wherein each of said witness screens comprises a sheet of material joined to each said baffle plate and covering said baffle plate aperture.

6. The test assembly in accordance with claim 1 wherein each of said sensors comprises a ring of electrically conductive material.

7. The test assembly in accordance with claim 1 wherein said bullet receptacle comprises a housing having therein a yielding material for capturing a bullet fired from the gun.

8. The test assembly in accordance with claim 7 wherein a bullet receiving end of said housing is covered by a self-sealing elastomeric membrane, for containing said yielding material.

9. The test assembly in accordance with claim 1 wherein:

said baffle plates are provided with a connection means for suspending said baffle plates in the body of liquid; and said witness screens are provided with a connection means for suspending said witness screens in the body of liquid.

10. A method for testing an underwater gun in a body of liquid, said method comprising:

providing a test assembly comprising, a mount for accepting and retaining the gun to be tested, a plurality of baffle plates, each plate having an aperture therethrough, a plurality of witness screens, a plurality of motion detection sensors, and a bullet receptacle;

placing said components in the body of liquid in alignment with each other such that a line extending from an axis of a gun barrel retaining portion of said mount extends through said apertures in said baffle plates, through said witness screens, through said motion detection sensors, and into said receptacle; and firing said gun whereupon said motion detection sensors provide a measure of bullet position along said line as a discrete function of time, said witness screens provide an indication as to the trajectory of the bullet, and the receptacle retains any bullet that traverses the entire range for retrieval and examination.

11. The method in accordance with claim 10 including the step of placing a pair of said motion detection sensors between two of said baffle plates.

12. The method in accordance with claim 10 including the step of placing each of said witness screens on one of said baffle plates, covering said aperture of said one baffle plate.

13. The method in accordance with claim 10 including the step of determining the time required for the bullet to pass from one of said motion detection sensors to another of said motion detection sensors, to provide a measure of mean velocity and deceleration.

14. The method in accordance with claim 10 including the step of observing bullet penetration holes in said witness screen, which provide said indication as to trajectory, and therefrom determining said trajectory.

* * * * *